US005551176A

United States Patent [19]

Hejhal et al.

[11] Patent Number: 5,551,176

[45] Date of Patent: Sep. 3, 1996

[54] ROLL COVER FOR FLAT WORK IRONER

[75] Inventors: Thomas J. Hejhal, Dunwoody; Scott W. Moore, Peachtree City, both of Ga.

[73] Assignee: Southern Mills, Inc., Union City, Ga.

[21] Appl. No.: 343,252

[22] Filed: Nov. 22, 1994

[51] Int. Cl.[6] ..... D06F 65/10; B30B 3/02

[52] U.S. Cl. ..... 38/44; 38/66; 29/895.23; 492/48

[58] Field of Search ..... 38/8, 44, 48, 56, 38/57, 62, 68, 66, 140; 29/895.21, 895.22, 895.23, 895.33; 492/48, 28; 102/93 RP, 155 R; 226/129, 190

[56] References Cited

U.S. PATENT DOCUMENTS

| | | | |
|---|---|---|---|
| 1,539,916 | 11/1924 | Siever | 38/66 |
| 2,101,449 | 12/1937 | Parry | 38/66 X |
| 2,333,824 | 11/1943 | Schoepf | 139/384 |
| 2,497,969 | 7/1947 | Smith | 38/65 |
| 2,667,685 | 11/1951 | Obitz | 28/78 |
| 2,762,111 | 9/1956 | Morgan | 29/128 |
| 2,974,240 | 2/1954 | Allen | 29/131 |
| 3,097,442 | 7/1963 | Willingham, Jr. | 38/66 |
| 3,151,408 | 10/1964 | Mazzolla | 38/57 X |
| 3,811,164 | 5/1974 | Faress et al. | 29/128 |
| 3,911,603 | 10/1975 | Lehrman | 38/140 |
| 4,325,998 | 4/1982 | Chapman | 428/36 |

*Primary Examiner*—Ismael Izaguirre
*Attorney, Agent, or Firm*—Hopkins & Thomas

[57] ABSTRACT

An improved roll cover for use on a flat work ironer is provided, having an improved resin coating. The roll cover is a sheet of thermally resistant fabric which is coated or impregnated with a mixture of an acrylic resin and a stiffening agent. The improved roll cover can be dyed to a particular desired color and will retain its color over extended use.

11 Claims, 3 Drawing Sheets

ROLL COVER FOR FLAT WORK IRONER

FIELD OF THE INVENTION

The invention relates to a roll cover for a flat work ironer of the type provided with a plurality of ironing rolls adapted to rotate in complementary seats in the upper surface of a steam chest for ironing flat work as the flat work is caused to move between the chest and the rolls. More specifically, the invention is directed to a roll cover which is formed by coating a thermally resistant fabric with an acrylic resin blended with a stiffening agent.

BACKGROUND OF THE INVENTION

A flat work ironer is a machine used in commercial or industrial laundries which serve large institutions such as hotels, hospitals, or restaurants to mechanically heat and press flat items such as bed linens, aprons, table linens, etc. The machine has a series of parallel rolls which are positioned in complementary-shaped semi-cylindrical polished seats formed in a chest that is heated by means of gas, steam, or thermal liquids such as hot oil.

The ironer functions by causing the flat work to be pressed between the heated chest and each roll in succession. The complementary shape of the rolls versus the shapes of the polished seats of the heated chest causes the flat work to be retained in contact with the heated chest longer than it would be if the heated chest were flat, so as to cause the moisture in the flat work to quickly evaporate and to remove the folds and wrinkles from the flat work. The chest typically is heated to and maintained at a temperature of at least approximately 300° F. but may reach temperatures of up to 450° F. The flat work typically is partially wet after having been washed and spun to a damp condition and is fed in at one end of the ironer by a surface conveyor, passed between the heated chest and the rolls and exits at the other end of the ironer in a substantially dry and wrinkle-free condition.

Typically, the rolls are fabricated of stainless steel and are hollow with a perforated cylindrical skin and perforated end walls to allow for steam generated in the ironing process to pass from about the cylindrical surfaces of the rolls into the interior of the rolls where it is removed by a vacuum system through one or both of the end walls of the roll. This creates air movement through and about the flat work so as to remove the high humidity air from about the ironer. The rolls usually are wrapped with a cushioning pad and then with an outer roll cover. The cushioning pad is typically made of a thermally resistant material such as, in the past, asbestos. More recently, this material is a combination of polyester and cotton or 100% recycled aramid or a combination of recycled aramid, polyester and/or cotton.

The roll covers must be thermally stable and hydrolysis resistant to provide for a wear life of at least one year under use of at least 40 hours per week. The covers should be of adequate stiffness to ensure a wrinkle free and smooth ironing surface. However, the cover should be porous to allow for the passage of steam through the cover.

In the past, roll covers for flat work ironers have been manufactured of asbestos fabric. For example, U.S. Pat. No. 2,333,824 to Schoepf teaches a ironer roll where both the pad and the outer cover are manufactured from asbestos. U.S. Pat. No. 2,497,696 to Smith teaches a cover made of asbestos fibers adhesively applied to a underlying pad. Other covers taught by the prior art references have been composed of muslin or duck, see U.S. Pat. No. 1,539,916 to Siever, and aluminum, see U.S. Pat. No. 2,762,111 to Morgan.

U.S. Pat. No. 3,811,164 to Faress, et al teaches the use of a cover composed of a fabric which has been impregnated with a thermosetting resinous material, specifically a phenolic resin. Preparation of phenolic resins requires the use of the chemical phenol which is a hazardous substance.

There are some disadvantages to use of the roll covers as taught by the prior art. Perhaps the most obvious are the environmental and health dangers associated with asbestos and phenol. Other problems with prior art roll covers have been in attaining desired characteristics such as porosity, smoothness, heat resistance, and wear resistance. Another disadvantage to the covers now used which are made with a phenolic resin is the appearance of the roll cover. These covers are brownish-yellowish in color when made and turn a darker brown as they are used. The manufacturers of the roll covers apparently have not been able to fabricate roll covers of different colors which retain the original colors over substantially the entire lifetime of the roll cover. Thus, the overall appearance is unaesthetic and the color instability of the covers makes them inconsistent and nonuniform in appearance.

SUMMARY OF THE INVENTION

It is an object of the present invention to provide a roll cover for a flat work ironer which overcomes the deficiencies and disadvantages of the prior art as described above and as generally known in the art.

Accordingly, it is an object of the present invention to provide a roll cover for a flat work ironer which is coated or impregnated with an acrylic blend resin and which functions in a superior manner over current roll covers.

It is an additional object of the present invention to provide a roll cover which has superior performance characteristics such as heat and wear resistance, porosity, stiffness and which is manufactured of non-hazardous materials.

A further object of the invention is to provide a roll cover which allows for greater color selection and better color stability and durability.

A still further object of the invention is to provide a roll cover for a flat work ironer which is more economically efficient because it is manufactured at a low cost and has superior performance qualities.

To achieve the above objects, a cover is taught for a flat work ironer roll which provides many advantages over the prior art in this area.

Briefly described, the present invention comprises a cover for a roll of a flat work ironer which comprises a thermally resistant fabric that is coated or impregnated with an acrylic resin which has been blended with a stiffening agent. The acrylic resin is safer and less expensive to apply to the thermally resistant fabric than phenolic resins which are currently used. The acrylic resin coated fabric provides necessary thermal resistance and structural stability at the high moisture and temperature conditions of the ironers. The cover made of the acrylic blend resin has increased porosity over phenol resin coated covers which allows for more moisture to be pulled through the cover. This allows for the ironer to be run at higher speeds thus leading to higher efficiency and production rates.

The present invention has increased color selection and stability over the known prior art covers. The prior art phenolic resins typically have a yellow shade when first applied to the roll cover material. This shade darkens to a brownish color when the coated fabric is cured during preparation of the cover and further darkens over time with the operation of the rolls. The acrylic blend resin, however, is initially colorless and typically does not darken with thermal exposure. The coated fabric may be colored by adding dye to the resin baths, and the fabric so coated with an acrylic blend which contains a dye will remain substantially on shade during prolonged use. This increased color selection and color stability allows for a more aesthetic appearance and also allows for the choice of utilization of specific colors for specific products, customers, uses, etc. Also, the uncoated fabric may be dyed to the desired shade before the clear acrylic resin is applied to yield a final colored coated fabric.

In accordance with the above objects the following detailed description is offered to allow enablement of the invention. The following description does not limit the invention to the description provided and it will be apparent to those skilled in the art that alternatives to the disclosed embodiment may also work.

DETAILED DESCRIPTION OF THE PREFERRED EMBODIMENT

Figure 1:
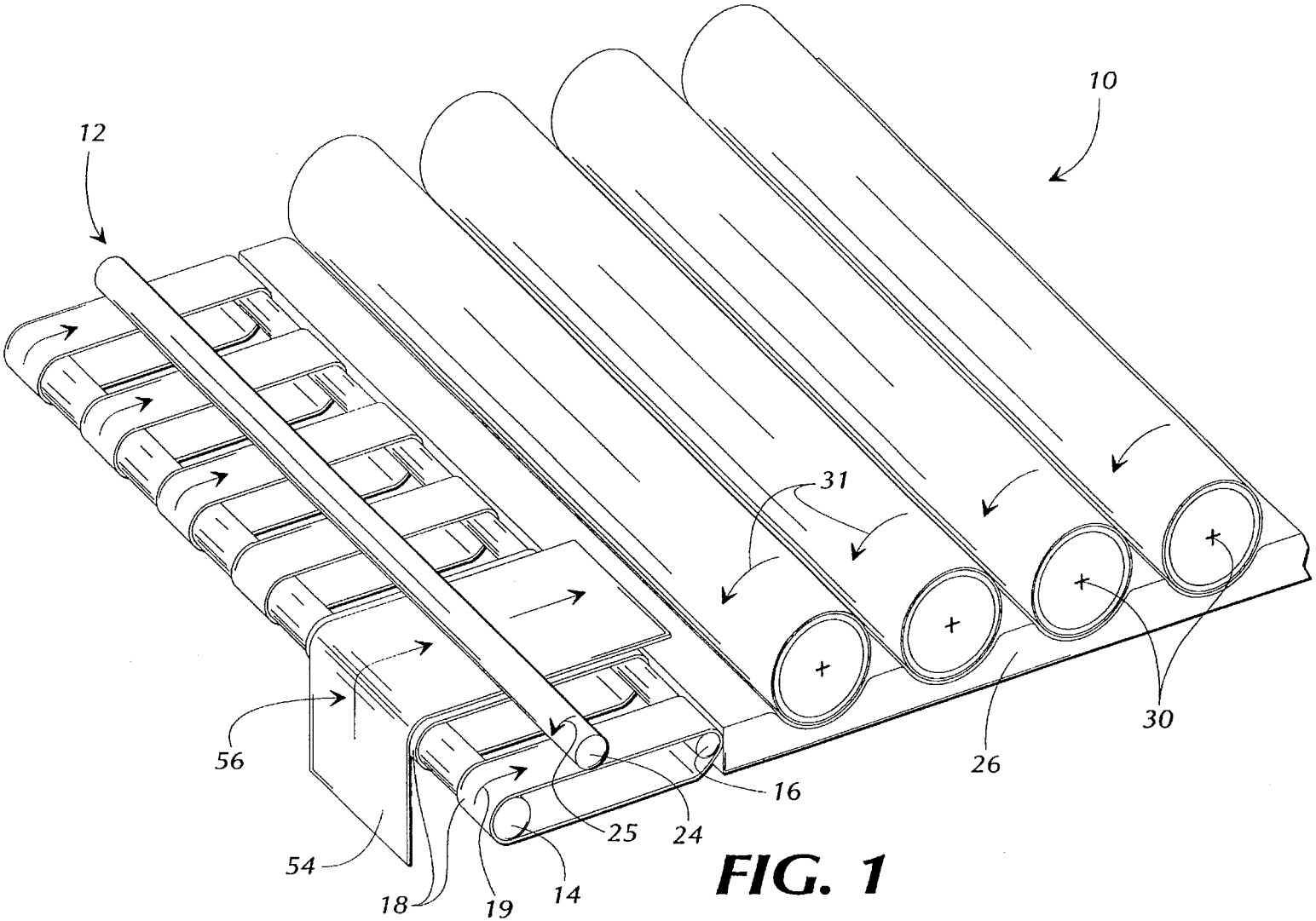
FIG. 1 is a perspective illustration of the flat work ironer.
Figure 5:
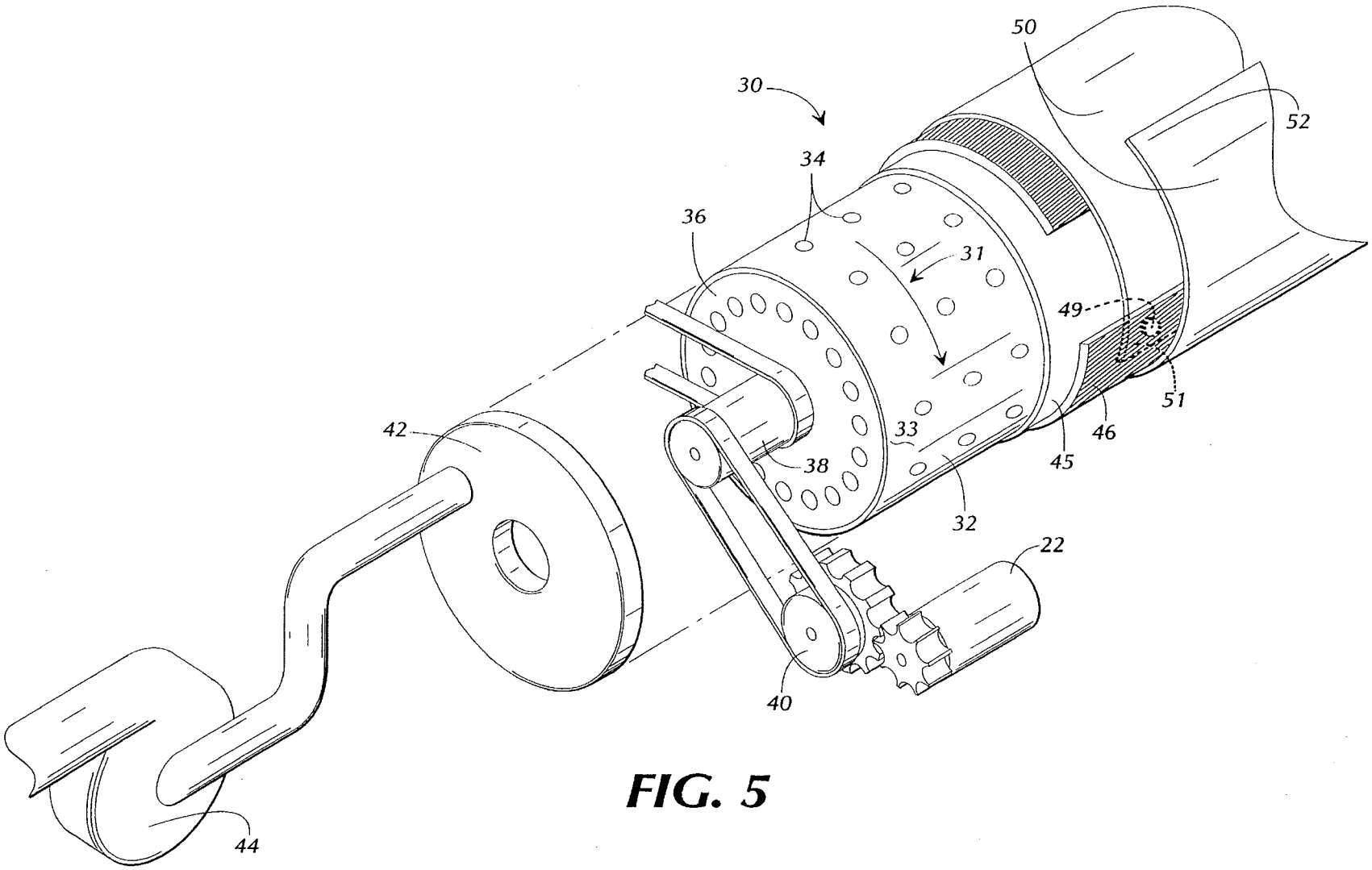
FIG. 5 is an exploded perspective view of a roll core with attached vacuum system and rotation shaft.

Referring now in more detail to the drawings in which like numerals indicate like pans throughout the several views, FIG. 1 shows a flat work ironer 10 of the type typically used for ironing flat piece goods such as tablecloths, napkins, bed sheets, etc. Ironer 10 includes a work table, or surface conveyor 12, which includes an entry roll 14, a return roll 16, and conveyor belts 18 that extend around the entry roll 14 and return roll 16 and rotate in the direction indicated by arrow 19. One of the rolls of the surface conveyor 12, such as return roll 16, is driven by an electric motor 22 (FIG. 5). Feed roll bar 24 extends across surface conveyor 12 and rotates oppositely from conveyor belts 18, in the direction indicated by arrow 25. Heated chest 26 lies adjacent and parallel to and at the same level as surface conveyor 12 and is heated to a temperature of, preferably, 300° F. to 330° F. by means which are known in the field, preferably by means of circulating hot gas, steam or hot oil. A plurality of polished parallel recesses 28 (FIG. 2) are formed in the top surface of heated chest 26 and are essentially semi-cylindrical troughs which correspond in shape and size to rolls 30 and which function as seats for the rolls 30. A series of typically six rolls 30 (only four are illustrated in FIG. 1 ) extend across heated chest 26, oriented essentially parallel to each other.

As shown more clearly in FIG. 5, a roll 30 has roll core 32 which typically is a stainless steel cylinder having a cylindrical wall 33. In the preferred embodiment, roll core 32 defines a plurality of perforations 34 in cylindrical wall 33 which function as air passages. Each roll core 32 is enclosed on both ends by end plates 36 which have extended therefrom shafts 38 which are connected to electric motor 22 and an intermediate drive system 40 to rotate rolls 30. At least one end plate 36 of the roll core 32 also has slidably attached thereto a stationary vacuum shoe 42 which communicates with the inlet of a blower 44 so that the blower 44 pulls a vacuum on the interior area of roll core 32.

Figure 4:
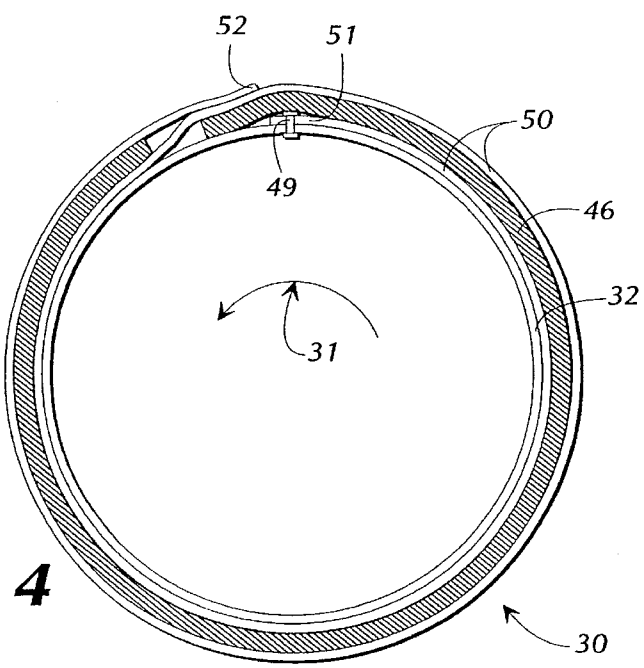
FIG. 4 is a detailed cross-sectional view of a roll showing a second embodiment of assembly of the roll core, pad and cover.
Figure 3:
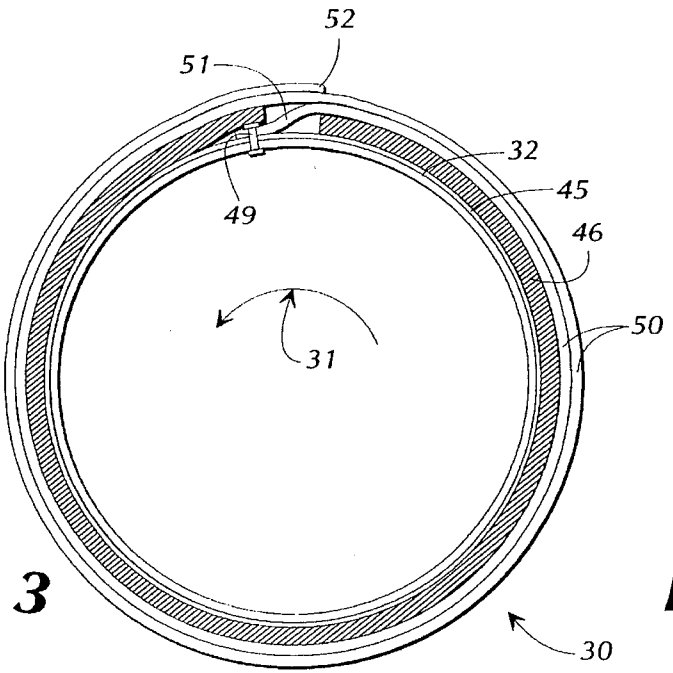
FIG. 3 is a detailed cross-sectional view of a roll showing one embodiment of assembly of the roll core, pad and cover.

FIGS. 3 and 4 show the construction of a roll 30 in more detail. A heat and moisture resistant pad 46 wraps around roll core 32. The pad may be protected from contact with the roll core 32 by placement of a screen cloth 45 (FIG. 3) between the roll core 32 and the pad 46. Screen cloth 45 can be made of any heat-resistant material, such as aramid fiber. Pad 46 is of substantially the same width as the length of roll core 32 and of sufficient length to wrap around roll core 32 one time. Preferably, pad 46 wraps around roll core 32 slightly less than one time so that as the roll 10 is used and pad 46 becomes compressed it does not start to overlap on itself. The trailing end of pad 46 trails freely behind as the roll 30 rotates in the direction away from the trailing end, as indicated by arrow 31.

Pad 46 can be composed of any of several suitable materials which are used in the field. For example, pad 46 can be a mixture of polyester and cotton, 100% recycled aramid, or a mixture of recycled aramid, polyester, and/or cotton. Aramid is the generic name for fiber made from the condensation product of isophthalic or terephthalic acid and m-or p-phenylenediamine. Pad 46 also can be a stainless steel knitted material.

Roll cover 50 is positioned about pad 46. Preferably, the leading end 51 of cover 50 is attached to roll core 32 by fasteners such as series of rivets or grommets 49. As shown in FIG. 3, which shows the assembly of a roll when a screen cloth 45 is placed between the roll core and the pad, cover 50 is fastened to roll core 32 at a line of connection 53 on roll core 32 ahead of attachment of pad 46. Cover 50 is spirally wound around roll core 32 on top of pad 46 and wraps round pad 46 and roll core 32 approximately two times.

A second embodiment of the roll cover, pad and roll is shown in FIG. 4. This is the preferred assembly of the roll and its cover when a screen cloth is not used. In this second embodiment, cover 50 is attached to the roll core at a line on roll core 32 past the line of attachment of pad 46. Cover 50 thus wraps around roll core 32 once under pad 46, then a second time on top of pad 46. In both embodiments of the invention the free end 52 of cover 50 is not fastened but instead trails freely. As the roll 10 is used this trailing end 52 can move to avoid bunching up of the cover 50 with expansion, compression or stretching of the pad or cover.

Cover 50 is formed of a resin coated thermally resistant fabric. The base fabric is one which can withstand exposure to temperatures up to 450° F. for prolonged periods of time. An example of an appropriate fabric is one made from woven aramid fiber. Other suitable fabric materials, by example, are flame resistant polyester, polybenzimidazole, polytetrafluoroethylene, polyetheretherketone, polyetherimide, polyethersulfone, polyimide, polyamide, polyimide-amide, modacrylic, acrylic, melamine, and glass.

The base fabric of cover 50 is woven and coated with a resin blend by means which are known in the art. Typically, a resin bath is used to coat the fabric evenly on both sides. The fabric is completely submerged in the bath and then the fabric is removed from the bath and rollers are used to squeeze the excess resin off the fabric. Alternatively, a system designed to apply latex to the back of carpet may be used. In this system, the fabric passes over the top of a roller which is half submerged in the resin bath. As the roller rotates it applies resin to the fabric and excess resin is removed from the fabric using a scraper blade. The fabric is then placed in an oven to dry the fabric and cure the resin. Typically, the drying/curing is accomplished using a tenter frame at an oven temperature of 390°–400° F. and the fabric is passed through the oven at a rate of approximately 5–20 yards per minute. The acrylic resin on the coated fabric of the present invention cures more quickly than phenolic resins used to coat fabrics currently. Therefore, the acrylic resin coated fabric of the present invention can be passed through the oven at a faster rate and the cost of curing the product is lower than the cost of curing the prior art phenolic coated product.

The resin blend of the present invention can be from about 4 to 40% by weight acrylic resin, preferably about 16 to 26%, and from about 2.5 to 30% by weight of a stiffening agent, preferably from about 5 to 15%. An anti-migrant agent may also be included as may a cross-linking catalyst such as ammonium chloride. If these are included they are each <1% by weight. The remainder of the bath is water. It is also anticipated that other resins may be used, such as, for example, a self cross-linking acrylic resin. In this case, a stiffening agent would not be required.

Preferred acrylic resins are acrylic copolymers such as, for example, but not limited to, GLOCRYL. GLOCRYL is the tradename for an anionic self-crosslinking acrylic copolymer manufactured by Glo-Tex Chemicals, Inc., P.O. Box 1019, Railroad Street, Roebuck, S.C. 29376. This acrylic copolymer has a boiling point of 212° F., a vapor pressure of 17 mmHg at 20° C., a specific gravity of 1.1 and is 55% volatile. The acrylic copolymer is an opaque water based emulsion, 55% water, with a low acrylic odor.

A stiffening agent is added to the acrylic resin in the resin bath to increase the "hand", or feel, and stiffness of the final coated fabric. The stiffening agent cross-links with the acrylic copolymer and forms a stiffer polymer than the acrylic copolymer would form polymerizing with itself. Stiffening agents include, but are not limited to, aqueous polymeric solution, hexamethoxymethyl-melamine, modified fatty amides, modified alkyd resin, modified formaldehyde carbamate, modified urea formaldehyde carbamate, melamine-formaldehyde, polyvinyl acetate, polyvinyl alcohol, polyurethane, polyethylene emulsion, polyether thermoplastic polyurethane, triazine-formaldehyde condensate, vinyl co-polymers with modified starch, other thermoplastic resins, and other thermoset resins.

An antimigrant agent may be added to the resin blend to stop migration of dye particles through the coated fabric and to maintain uniformity of color shade across the coated fabric. Examples of anti-migrant agents which are suitable are nonionic, linear polymeric anhydride, anionic polyacrylamide and formulated polyamide anti-migrant agents. ASTROTHERM AM, a formulated polyamide manufactured by GLO-TEX Chemicals, Inc. of Roebuck, S.C., was used with successful results.

A cross-linking catalyst such as ammonium chloride may be included in the resin to speed up the polymerization reaction between the stiffening agent and the acrylic copolymer.

The resin blend may also include one or more coloring agents, such as pigments and dyes, to impart to the coated fabric the desired color. Acid dyes have been used in the present invention with success due to the small size of these dye particles. However, any coloring agents which do not migrate across the fabric and which do not leach off of the fabric during use of the roll covers would be suitable as well.

OPERATION

Figure 2:
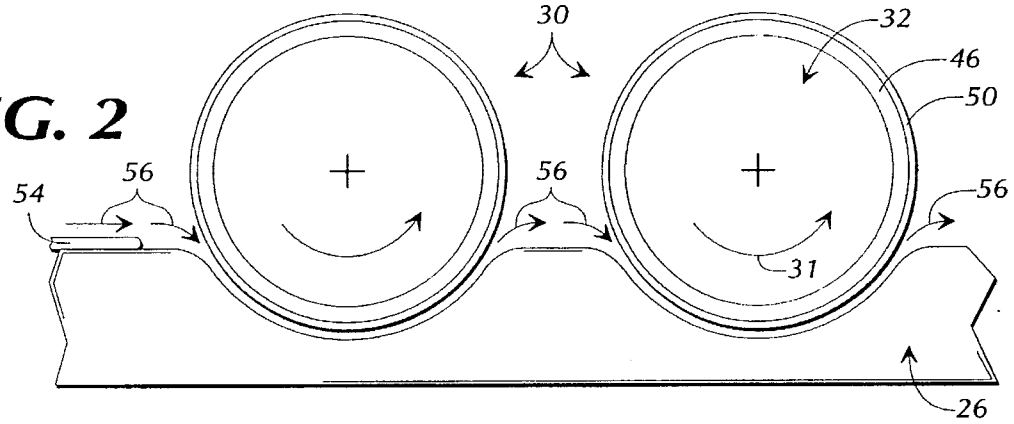
FIG. 2 is a side view of a pair of rolls of the flat work ironer and corresponding recesses of the heated chest.

The flat work 54, preferably dampened, shown in FIGS. 1 and 2 as a table napkin, enters ironer 10 across surface conveyor 12 via transportation by conveyor belts 18 and feed roll bar 24. Flat work 54 follows the movement of directional arrows 56 shown in the several views of the invention. Flat work 54 then moves across heated chest 26 and sequentially through each recess 28 and underneath each roll 30. Rolls 30 rotate in the direction indicated by arrow 31 and push/pull flat work 54 across the ironer 10. Each roll 30 contacts the flat work and flat work 54 is pressed or ironed between each roll in its corresponding recess. This contact with heated chest 26 and each roll 30 presses and dries flat work 54. The moisture from flat work 54 is evaporated into the air and also is pulled from flat work 54 by the vacuum created in the interior of roll core 32. Thus, moisture is pulled from flat work 54 through cover 50 and pad 46 and through the perforations 34 of roll core 32. The moisture is then pulled out of the ironer by vacuum means. Flat work 54 exits ironer 10 pressed and dried. The speed of rolls 30 can be adjusted to ensure flat work 54 stays in the ironer long enough to become dry.

EXAMPLE 1

A roll cover was fabricated as follows:

A woven material was formed with aramid warp and filler yams, with 37.5 warp yams per inch and 37 filler yams per inch. The denier of both yams was 665 (16/2 cotton count).

Once the fabric was woven, it was submerged in a bath of acrylic resin, a stiffening agent and dyes. The acrylic resin was GLOCRYL NCR, and the stiffening agent was AEROTEX M-3 Resin. The acrylic resin of the liquid mixture was 21% by weight, the stiffening agent was 9% by weight. Acidol Dyes from BASF, Red, Blue, and Yellow were used to color the fabric in the following amounts:

| Color | % by Weight of Bath |
|---|---|
| Red | 0.045 |
| Blue | 0.023 |
| Yellow | 0.630 |

Also included in the bath were an anti-migrant (Astrotherm AM—0.90%), and a catalyst (Ammonium Chloride—0.50%). The liquid bath was maintained at ambient room temperatures. The dyes were separately dissolved in hot water before mixing with the other diluted ingredients.

The fabric was submerged in the resin and then run through a pair of pad rollers which squeezed the excess resin out of the fabric. Because this was a continuous operation, the time of submersion varied with the speed of the tenter frame. The pad rollers maintain a constant pressure, however, and so resin pick-up tends to be uniform regardless of production speeds.

The resin impregnated fabric was then passed through a drying oven maintained at 400° F. for a period of 2 to 3 minutes. The rate of passage of the fabric was 15 yards per minute. The fabric passed through cooling zones at the end of the oven, which brought the temperature down to 150° F. or less, before being rolled up on an automatic wind-up unit.

EXAMPLE 2

The process of Example 1 was repeated with the following changes:

The resin blend was 4% by weight acrylic resin, 2.5 % by weight stiffening agent, by weight ammonia chloride and the balance water. The resulting fabric had less stiffness than the fabric of Example 1.

EXAMPLE 3

The process of Example 1 was repeated with the following changes:

The resin blend was 15% by weight acrylic resin, 6% by weight stiffening agent, 1% by weight antimigrant agent, 0.5% by weight catalyst, 0.060% by weight red dye, 0.028% by weight blue dye and 0.750% by weight yellow dye. The resulting fabric performed acceptably, although the hand was softer than the fabric of Example 1.

The products of Examples 1, 2 and 3 were cut to size and were attached over a pad to a roll of a flat work ironer with a heated chest and operated to heat and press flat work products such as pillow cases, sheets, towels and other hotel supplies. Over a period of one year, the color of the roll covers was maintained without any noticeable fading, darkening or other color change. Further, there was no perceptible wear on the roll covers. The covers functioned as well as the phenolic resin coated covers typically used for such work.

While preferred embodiments of the invention have been disclosed in detail herein, it will be obvious to those skilled in the art that variations and modifications of the disclosed embodiments can be made without departing from the spirit and scope of the invention as set forth in the following claims.

We claim:

1. In a flat work ironer of the type including a plurality of rotatable cylindrical rolls received in a series of semi-cylindrical parallel recesses of a heated chest, the improvement therein of a roll cover assembly for at least some of the cylindrical rolls comprising:

a compressible pad for surrounding said roll, and a roll cover adjacent said pad for surrounding said pad, each of said pad and roll cover attached at one of its edges to its cylindrical roll with its other edge in freely trailing relationship about its roll as the roll rotates, said roll cover comprising a sheet of thermally resistant fabric coated with a mixture comprising an acrylic resin and a stiffening agent.

2. The invention of claim 1 wherein the thermally resistant fabric is a woven aramid fabric.

3. The invention of claim 1 wherein said mixture comprising an acrylic resin and a stiffening agent is characterized by having been applied to the fabric as a resin bath which comprises 4 to 40% by weight of acrylic resin and 2.5 to 30% by weight of stiffening agent.

4. The invention of claim 3 wherein the resin bath further comprises a coloring agent.

5. The invention of claim 1 wherein said mixture comprising an acrylic resin and a stiffening agent is characterized by having been applied to the fabric as a resin bath which comprises 21% by weight of acrylic resin and 9% by weight of stiffening agent.

6. The invention of claim 1 wherein said pad is comprised of aramid fiber.

7. The invention of claim 1 wherein said pad is comprised of knitted stainless steel.

8. An ironer roll cover comprising a sheet of thermally resistant fabric coated with a mixture comprising an acrylic resin, a stiffening agent and a coloring agent, said fabric sheet having a width substantially equal to the length of said ironer roll and a length sufficient to wrap around said ironer roll at least one time.

9. The ironer roll cover of claim 8 wherein the thermally resistant fabric is a woven aramid fabric.

10. The ironer roll cover of claim 8 wherein said cover is characterized by said mixture having been applied to the fabric as a resin bath which comprises 4–40% by weight acrylic resin and 2.5–30% by weight stiffening agent.

11. In a flatwork ironer of the type having a heated chest defining semi-cylindrical parallel polished recesses for receiving rotatable ironing rolls, a rotatable ironing roll positioned in each recess, a compressible pad attached to each ironing roll at one edge of the pad and surrounding its ironing roll, a roll cover attached to each ironing roll at one edge of the cover and surrounding its ironing roll and pad, the improvement therein of:

said cover comprising a woven aramid fabric coated with a mixture comprising an acrylic resin, a stiffening agent and a coloring agent.

* * * * *